United States Patent [19]

Becherer

[11] 4,324,481

[45] Apr. 13, 1982

[54] DEVELOPING MACHINE FOR RADIATION-SENSITIVE MATERIAL

[75] Inventor: Walter Becherer, Munich, Fed. Rep. of Germany

[73] Assignee: AGFA-Gevaert AG, Leverkusen, Fed. Rep. of Germany

[21] Appl. No.: 229,770

[22] Filed: Jan. 29, 1981

[30] Foreign Application Priority Data

Feb. 14, 1980 [DE] Fed. Rep. of Germany ..... 3005471

[51] Int. Cl.[3] ..... G03D 3/06

[52] U.S. Cl. ..... 354/324; 137/142; 137/563

[58] Field of Search ..... 354/324; 137/142, 147, 137/563

[56] References Cited

U.S. PATENT DOCUMENTS

| | | | |
|---|---|---|---|
| 3,480,025 | 11/1969 | Hsu et al. | 137/563 |
| 3,631,885 | 1/1972 | Graville | 137/142 |
| 4,215,719 | 8/1980 | Laar et al. | 137/563 |
| 4,263,932 | 4/1981 | Laar et al. | 354/324 |

*Primary Examiner*—L. T. Hix
*Assistant Examiner*—Alan Mathews
*Attorney, Agent, or Firm*—Kontler & Grimes

[57] ABSTRACT

A rinsing tank in a developing machine for X-ray films or the like is equipped with a circulating system which draws liquid from the bottom zone of the tank and returns the withdrawn liquid to the upper zone of the tank. The contents of the tank can be evacuated without resorting to any values by using a siphon whose intake end is connected with the suction side of a jet pump in the pipeline for circulation of liquid, the uppermost section of which is located at a level below the normal level of the upper surface of the body of liquid in the tank, and the discharge end of which is connected with a liquid removing pipe. When the pump which causes the liquid to circulate by flowing through the pipeline is arrested, the jet pump is deactivated and allows the liquid in the siphon to rise and to flow into the uppermost section. The liquid thereupon continues to leave the tank in the form of a continuous stream which flows along a second path defined by a portion of the pipeline, the jet pump and the siphon. If the operator wishes to interrupt the evacuation of liquid from the tank, an aerating valve is caused to admit air into the uppermost section of the siphon and to thus break the continuous stream of outflowing liquid. In normal operation, the upper surface of the column of liquid in that section of the siphon which connects the suction side of the jet pump with the uppermost section is located below the uppermost section. The jet pump is installed at a level below the bottom zone of the tank, and the pump which circulates the liquid is located at a level above such bottom zone but below the normal level of the upper surface of the body of liquid in the tank.

15 Claims, 1 Drawing Figure

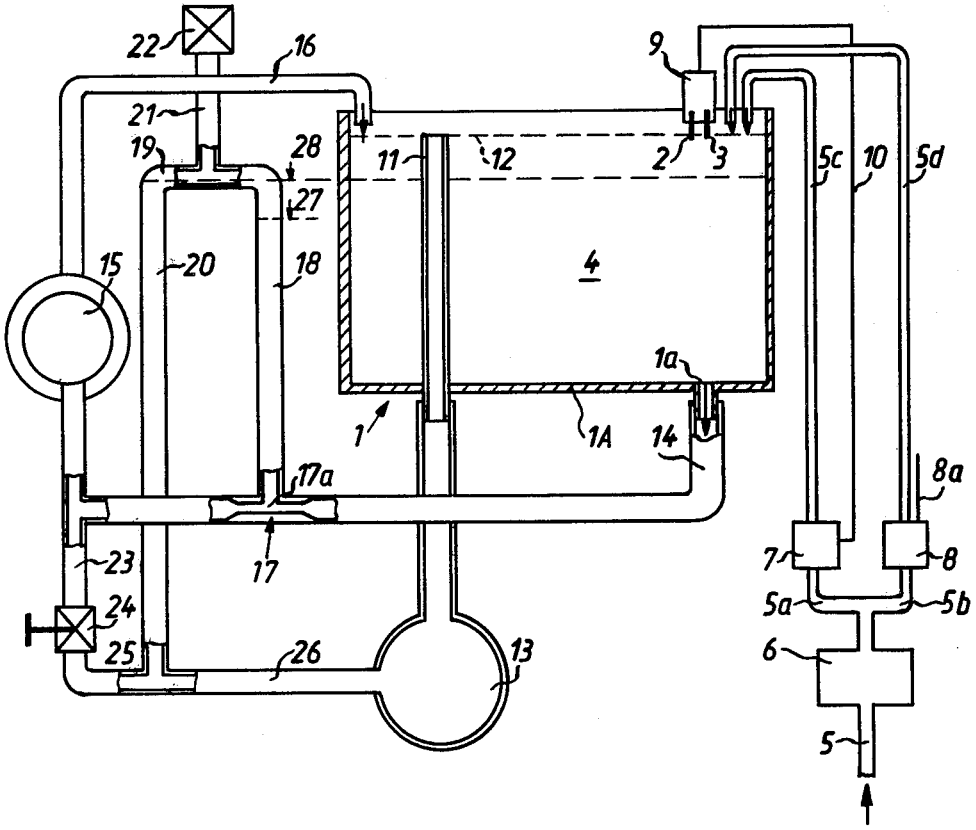
22
16
9
21
19
28
11
12
2
3
5c
10
5d
27
15
20
18
4
1a
1
1A
14
17a
8a
23
17
7
8
24
5a
5b
25
26
13
6
5

DEVELOPING MACHINE FOR RADIATION-SENSITIVE MATERIAL

BACKGROUND OF THE INVENTION

The present invention relates to developing machines for radiation-sensitive material. More particularly, the invention relates to improvements in means for circulating a liquid in a tank or another suitable vessel which is utilized in a developing machine for photosensitive or other radiation-sensitive materials.

It is well known to utilize in a developing machine for radiation-sensitive material a series of successive vessels through which the exposed material advances to be subjected to treatment by different liquids. For example, when the photosensitive material is a web or strip of photographic film or photographic paper, such web or strip will advance seriatim first through a developing bath, thereupon through a fixing bath and finally through a rinsing bath on its way toward and through a drying chamber. As a rule, the rinsing bath comprises an open-top tank or another suitable vessel with an outlet opening in the bottom wall thereof, and a system which circulates the fluid leaving the interior of the vessel by way of the outlet opening back into the upper portion of the supply of liquid in the vessel. The circulating system comprises a pump which draws the liquid through the outlet opening and causes the liquid to flow to a level above the upper surface of the supply of liquid in the vessel.

The situation is analagous in automatic or semiautomatic developing machines for X-ray films. In such machines, too, the exposed film is transported through developing, fixing and rinsing baths prior to drying for the purpose of removing the surplus of moisture from its sides. The function of the rinsing bath is to wash away salts and ions which tend to adhere to the radiation-sensitive emulsion. Such constituents are caused to contact the X-ray film during preceding chemical treatment in the developing and fixing vessels. Furthermore, rinsing is desirable and advantageous because it enhances or prolongs the useful life or storage life of fully exposed and developed X-ray films.

It is further well known that the liquid which fills the rinsing tank tends to accumulate suspended matter which floats in the filtered body of liquid, normally water. Such suspended matter can exert an adverse influence upon the X-ray film. The suspended matter includes remnants of gelatin which is washed out of the emulsion and/or algae which penetrate into the vessel with inflowing water and utilize the remnants of gelatin as an ideal breeding ground for rapid multiplication in the interior of the rinsing vessel. The deleterious effects of such microorganisms are twofold. First of all, the suspended matter is likely to form on the developed film spots which tend to obscure the image on the X-ray film. It is quite likely that a spotted fully developed X-ray film will lead to inaccurate diagnoses and unsatisfactory or improper treatment of patients. Secondly, the suspended matter is likely to deposit on the film transporting equipment, such as rollers, whereby the deposits adversely affect the configuration of the film-contacting surfaces of the rollers. This can lead to problems in connection with automatic transport of X-ray films through the vessels in the developing machine.

There exist many proposals to eliminate the presence or spreading of suspended matter in rinsing tanks of automatic developing machines for radiation-sensitive material. For example, it was proposed to add algicides at regular intervals. Such substances are designed to prevent further multiplication of algae. However, it has been found that algae which are present in the vessel at the time of admission of such substances are not affected at all so that the failure of an attendant to admit algicides at regular intervals can entail a pronounced growth of algae with the aforediscussed consequences. Furthermore, the cost of algicides is extremely high. Moreover, the remnants of gelatin are not affected by the addition of such substances.

Another prior proposal to prevent the development and multiplication of suspended matter includes continuous replacement of the contents of a rinsing tank. However, this is extremely costly, not only because of the consumption of excessive quantities of water but also as regards the energy requirements of the equipment which effects circulation of water, namely, the evacuation of water from the interior of the vessel and continuous admission of fresh water to replace the evacuated liquid.

It is also known to provide the rinsing vessel of a developing machine with a shutoff valve which is opened as soon as the developing machine is brought to a standstill. When the developing machine is started again, the shutoff valve is closed and the attendants open one or more additional valves which admit fresh rinsing liquid into the interior of the vessel. The filling of the vessel is monitored by electrodes which close the valve of valves for admission of fresh rinsing liquid as soon as the upper surface of the accumulated liquid in the rinsing vessel has risen to a predetermined level. As a rule, the shutoff valve and the fluid-admitting valve or valves are solenoid-operated valves which are quite sensitive and expensive. Relatively inexpensive solenoid-operated valves define rather small paths for the flow of liquids therethrough. Consequently, such valves are highly likely to be clogged by suspended matter after a relatively short period of use. This applies in particular to the aforementioned shutoff valve. On the other hand, solenoid-operated valves which provide relatively large passages for the flow of a liquid therethrough are quite complex and expensive.

OBJECTS AND SUMMARY OF THE INVENTION

An object of the invention is to provide a novel and improved developing machine wherein the circulation of liquid in a rinsing vessel or another vessel of the machine can be carried out in a simple, inexpensive and reliable way without permitting the accumulation and breeding of suspended matter in the interior of the vessel.

Another object of the invention is to provide the developing machine with a vessel and with a novel equipment which can circulate the liquid in the vessel without resorting to expensive and/or unreliable valves.

A further object of the invention is to provide a novel and improved system for circulating the liquid contents of a rinsing vessel in a machine for the development for X-ray films.

Still another object of the invention is to provide the vessel with novel and improved means for facilitating rapid evacuation of liquid when the developing machine is arrested and for rapid refilling of the vessel prior to or in response to starting of the developing machine.

Another object of the invention is to provide the machine with a novel and improved rinsing vessel and appurtenant equipment.

An additional object of the invention is to provide a rinsing vessel which is constructed, assembled and associated with appurtenant equipment in such a way that the admission, retention and/or breeding of suspended matter, especially algae, is much less likely than in the rinsing vessels of heretofore known developing machines for X-ray films or the like.

The invention resides in the provision of a developing machine for radiation-sensitive material, such as X-ray films. The improvement comprises a vessel having an upper portion and a lowermost portion and serving to normally confine a body of liquid having an upper surface located at or at least close to a predetermined level, means for circulating the liquid along a first path extending from the lowermost portion of the vessel, outside of the vessel and to the upper portion of the vessel (such circulating means includes or may include pipe means and a first pump which is installed in the pipe means), liquid removing means (e.g., one or more pipes which deliver spent liquid to a drain, into a sewage line or the like), and means for evacuating the contents of the vessel in response to stoppage of the first pump by causing the liquid to flow along a second path extending between an intermediate portion of the first path and the removing means. The evacuating means includes a jet pump which is installed in the intermediate portion of the first path and has a suction side, and a siphon having an intake end connected with the suction side of the jet pump and a discharge end connected with the liquid removing means. The uppermost section of the siphon is located at a level above the jet pump but below the predetermined level of the upper surface of the body of liquid in the vessel. When the first pump (e.g., a centrifugal pump) is arrested, the jet pump is automatically deactivated whereby its suction side ceases to maintain the top surface of the column of liquid in the siphon below the uppermost portion of the siphon, i.e., the column can rise and the liquid flows through the siphon in the form of a continuous stream until the contents of the vessel are evacuated into the liquid removing means.

The jet pump is preferably disposed at a level below the lowermost portion of the vessel, e.g., in a horizontal or nearly horizontal pipe forming part of the aforementioned pipe means which latter further include a second pipe containing the first pump and extending upwardly from the first pipe so as to discharge the circulating liquid into the upper portion of the vessel.

In addition to the aforementioned uppermost section, the siphon preferably further includes a first substantially upright section which extends from the suction side of the jet pump to the uppermost section and a second upright or nearly upright section which connects the uppermost section with the liquid removing means.

The jet pump is preferably dimensioned in such a way that, when the first pump is on, the upper surface of the column of liquid in the first upright section of the siphon is sufficiently below the uppermost section to ensure that relatively minor fluctuations of the level of the upper surface of liquid in the vessel cannot entail the development of a continuous stream of liquid flowing from the jet pump, through the siphon and into the removing means when the first pump is in operation. However, when the first pump is arrested, i.e., when the jet pump is deactivated, suction at the suction side of the jet pump disappears so that the column of liquid in the first upright section of the siphon rises to flow through the uppermost section and into the second upright section and thence into the removing means.

It is often preferred to further provide means for admitting air into the uppermost section of the siphon. Such air admitting means may comprise an upwardly extending tubular connector the lower end portion of which communicates with the uppermost section of the siphon and which contains a normally closed aerating valve. The valve is opened, either automatically or by an attendant, when the attendant wishes to interrupt the evacuation of liquid from the vessel, i.e., to refill the vessel prior to completion of evacuation of the entire body of liquid from the vessel. The admitted air then interrupts the flow of liquid through the siphon and enables one or more conduits which receive fresh liquid (e.g., rinsing water) from a tap or another suitable source to rapidly refill the vessel, i.e., to cause the upper surface of the body of liquid therein to again rise to the aforementioned predetermined level.

The first pump is preferably disposed between the lowermost portion of the vessel and the predetermined level.

The novel features which are considered as characteristic of the invention are set forth in particular in the appended claims. The improved developing machine itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a schematic partly elevational and partly vertical sectional view of a portion of a developing machine for radiation-sensitive material which embodies one form of the present invention.

DESCRIPTION OF THE PREFERRED EMBODIMENTS

The drawing illustrates a portion of a developing machine for radiation-sensitive material, for example, an automatic developing machine for X-ray films. The machine comprises a series of vessels of which only one, namely, a tank 1, is shown in the drawing. This tank contains a supply or body 4 of liquid which is used for a particular treatment of exposed films. It is assumed that the tank 1 is a rinsing vessel and that the liquid which normally fills the tank 1 to a predetermined level 12 is water. A control unit 9 which may but need not be mounted directly on the tank 1 comprises two electrodes 2 and 3 which extend downwardly to different levels and serve to automatically regulate the quantity of liquid in the tank 1.

A liquid supplying pipe 5 is connected to a conventional source of water (e.g., a faucet) and can deliver liquid to a pair of discrete branches 5*a*, 5*b* by way of a filter 6. The branch 5*a* communicates with a pipe 5*c* in response to opening of a first valve 7, and the branch 5*b* communicates with a pipe 5*d* in response to opening of a second valve 8. The valves 7 and 8 are or can be solenoid-operated valves. The purpose of the filter 6 is to intercept coarser impurities, such as particles of chalk or the like. The upper end portions of the pipes 5*c* and 5*d* are disposed at a level above the open top of the tank (or above an open portion of the top of the tank 1) and discharge streams of filtered water into the tank in response to opening of the respective valves 7 and 8.

The reference character 8*a* denotes conductor means for transmission of signals which entail opening or closing of the valve 8. Such signals are transmitted by the controls of the developing machine and cause the valve 8 to open when the developing machine is started so as to ensure rapid filling of the tank 1 to the desired level 12. The valve 7 is opened or closed in response to signals which are generated by the control unit 9 and are transmitted via conductor means 10. The purpose of the valve 7 is to admit relatively small quantities of water for the purposes of regeneration while the machine embodying the structure which is shown in the drawing is in actual use.

The bottom wall 1A below the lowermost portion of the interior of the tank 1 is traversed by an overflow pipe 11 whose open upper end is located at the level 12 and which discharges into a liquid removing pipe 13 serving to collect spent liquid for delivery to the sewage system or to another destination. The position of the overflow pipe 11 relative to the tank 1 is such that, in normal operation of the developing machine, the upper surface of the supply of water in the tank remains at or is always close to the predetermined level 12.

The bottom wall 1A of the tank 1 is further formed with an outlet opening 1*a* which is connected to the intake of a centrifugal liquid circulating pump 15 by a pipe 14. The outlet of the pump 15 delivers liquid into a pipe 16 which discharges the liquid into the upper portion of the tank 1. In the illustrated embodiment, the open discharge end of the pipe 16 is located above the predetermined level 12. The pipes 14, 16 provide a first path for circulation of liquid from the lowermost portion of the tank 1 (via outlet opening 1*a*) to the upper portion of such tank as long as the pump 15 is driven by its motor, not shown. The pump 15 is installed in the pipe 16 which extends upwardly from the pipe 14. The latter is located at a level below the bottom wall 1A.

In accordance with a feature of the invention, the tank 1 can be completely emptied in an automatic way in response to stoppage of the motor for the pump 15. To this end, the pipe 14 contains a jet pump 17 whose suction side 17*a* is in communication with one end portion of an n-shaped (or inverted U-shaped) siphon including a first upright section 18, an uppermost section 19 at the upper end of the section 18, and a second upright section 20 extending from the respective end of the uppermost section 19 to a pipe 26 which communicates with or forms part of the liquid removing pipe 13. In the illustrated embodiment, the sections 18, 20 of the n-shaped siphon are vertical and the section 19 of such conduit is horizontal. It will be noted that the horizontal upright section 20 is disposed below the level 12 and that an intermediate portion of this uppermost section communicates with the lower end portion of an upwardly extending tubular connector 21 whose upper end portion is normally sealed by an aerating valve 22. The jet pump 17 is located at a level below the bottom wall 1A of the tank 1, and the centrifugal pump 15 is located between the predetermined level 12 and the level of the bottom wall 1A. The liquid removing pipe 13 is located at a level below the evacuating means 17–20.

As a customer service, the structure which is shown in the drawing may further comprise a pipe 23 which connects the pipe 14 with the liquid removing pipe 13 by way of the aforementioned pipe 26 and contains a normally closed shutoff valve 24. The reference character 25 denotes a tee between the lower end portion or discharge end of the siphon section 20 and the pipes 23, 26. The locus of communication between the pipes 14 and 23 is downstream of the jet pump 17.

The operation:

When the developing machine is in use, the motor of the pump 15 is on so that a continuous stream of liquid flows from the lowermost portion of the tank 1 through the outlet opening 1*a*, through the pipe 14 and the jet pump 17, through the pump 15 and through the pipe 16 back into the upper portion of the tank 1. As explained above and as shown in the drawing, the circulating means 14, 15, 16 draws liquid from the bottom zone of the tank 1 and returns the withdrawn liquid to the body 4 in the region of the predetermined level 12. The body 4 of liquid in the tank 1 cannot rise above the level 12 because the surplus flows into the removing pipe 13 via overflow pipe 11. On the other hand, the supply of liquid cannot descend well below the level 12 because the electrodes 2, 3 then initiate opening of the solenoid-operated valve 7 which allows fresh water to flow from the liquid supplying pipe 5, through the filter 6, through the branch pipe 5*a*, through the open valve 7, and through the pipe 5*c* to be discharged into the upper part of the body 4 of liquid in the tank 1.

In normal operation, the level of the upper surface of the column of liquid in the upright section 18 of the n-shaped siphon 18–20 is at 27, i.e., below the level 12 in the tank 1. This is due to the fact that, even though the liquid which fills the tank 1 to the level 12 tends to flow through the outlet opening 1*a* and pipe 14 into the section 18 and up to the level 12, the suction side 17*a* of the jet pump 17 draws liquid from the section 18 as long as the pump 15 causes the liquid to flow from the conduit 14 into the conduit 16. The dimensions of the jet pump 17 and the position of the siphon 18–20 relative to the tank 1 can be readily selected in such a way that the level 27 is somewhere (e.g., slightly) below the uppermost section 19 of the siphon. The shutoff valve 24 is normally closed, not only when the motor for the pump 15 is on but also when the developing machine is idle; this valve is opened by an attendant when the attendant desires to clean the apparatus or for the purposes of repair. Opening of the shutoff valve 24 (e.g., by hand) results in rapid evacuation of the supply of liquid from the siphon and all pipes as well as from the tank 1.

If the developing machine is arrested, the motor for the pump 15 is brought to a standstill so that the jet pump 17 is deactivated and its suction side 17*a* ceases to draw liquid from the siphon 18–20. The liquid then flows from the tank 1, through the outlet opening 1*a*, pipe 14 and into the section 18 so that the siphon 18–20 is filled to the level 28 which is the new level of the upper surface of the body of liquid in the tank 1. Consequently, the uppermost section 19 of the siphon 18–20 receives liquid and such liquid flows via section 20 and tee 25 into the pipe 26 and thence into the removing pipe 13. Owing to the well known siphon principle, the entire contents of the tank 1 are evacuated via outlet opening 1*a*, pipe 14, jet pump 17, sections 18, 19, 20 of the siphon 18–20, tee 25, and pipe 26. The stream of outflowing liquid is interrupted when the pipe 14 admits air into the jet pump 17. Since the pump 15 is located at a level above the bottom wall 1A and the jet pump 17 is located at a level below the bottom wall 1A, the tank 1 is empty and the pump 15 is also empty when the jet pump 17 receives air, i.e., when the stream of liquid which flows into the removing pipe 13 via siphon 18–20 is interrupted.

If the volume of the tank 1 (up to the level 12) is approximately 20 liters, and if the inner diameters of the sections 18, 19, 20 are approximately 9 millimeters, the entire contents of the tank 1 can be evacuated within an interval of approximately 6–8 minutes.

If the developing machine is to be started again, the motor for the pump 15 is started and the solenoid-operated valves 7, 8 are open (the valve 7 is open because the tank 1 is empty, i.e., because the upper surface of the (non-existent) body of liquid in the tank 1 is below the electrodes 2 and 3, and the valve 8 is opened in automatic response to starting of the developing machine). Consequently, the pipes 5*c* and 5*d* deliver streams of filtered liquid into the tank 1 from above, and the pump 15 causes the liquid which gradually fills the tank to circulate along the path which is defined by the pipe means 14, 16. When the upper surface of the rising body of liquid in the tank 1 reaches the electrodes 2 and 3, i.e., the predetermined level 12, the valves 7 and 8 are closed and the developing machine is ready for use, i.e., the tank 1 can receive exposed, developed and fixed films for the purpose of rinsing. When the upper surface of liquid in the tank 1 rises to the level 12, the jet pump 17 ensures that the upper surface of the column of liquid in the section 18 of the siphon 18–20 does not rise above the level 27, i.e., that such level is below the lowermost part of the interior of the uppermost section 19.

The aerating valve 22 is or can be a solenoid-operated valve and is normally closed. It is opened only for the purpose of admitting air, when necessary, into the siphon 18–20. For example, aeration of the siphon 18–20 is in order when the attendant decides to refill the tank 1 prior to completion of evacuation of the entire body of liquid. At such time, liquid flows from the tank 1 into the removing pipe 13 via siphon 18–20 owing to the well-known siphon principle and the suction at the side 17*a* of the jet pump 17 does not suffice to interrupt such outflow of liquid. In the absence of admission of air into the uppermost section 19 via valve 22 and tubular connector 21, the freshly admitted liquid would be free to flow from the tank 1, via conduit 14, jet pump 17, siphon 18–20, tee 25 and pipe 26 into the removing pipe 13. In other words, the valve 22 is needed only if the apparatus which is shown in the drawing is to be capable of interrupting evacuation of the contents of the tank 1 for the purpose of refilling the tank via pipes 5*c* and 5*d* before the entire body of liquid has been removed via outlet opening 1*a*, pipe 14, jet pump 17, siphon 18–20, tee 25 and pipe 26.

An important advantage of the improved machine is that the cross sections of channels or passages for the outflow of liquid from the tank 1 are sufficiently large to greatly reduce or completely eliminate the likelihood of clogging. Moreover, the apparatus which is shown in the drawing is very simple and inexpensive. The parts which convey the liquid during evacuation of the contents of the tank 1 can be made of synthetic plastic material. By appropriate selection of such material, namely, by selection of a plastic material which can stand the action of chemicals in the liquid that fills the tank, the apparatus can be used with equal advantage for circulation of liquids other than water, e.g., for circulation of the contents of a developing or fixing tank. The evacuating means need not comprise any mobile mechanical parts and/or complex electronic components. This reduces the likelihood of wear (absence of mobile mechanical components) and simplifies the construction, initial as well as maintenance cost (absence of complex electronic equipment). Still further, and when compared with heretofore known and used evacuating equipment, the evacuating means of the improved machine renders it possible to cut in half the time which is needed to evacuate the contents of the tank 1.

The improved apparatus is further capable of automatically indicating eventual or possible defects of the pump 15. Thus, if the liquid level in the tank 1 decreases continuously, suction in the section 18 of the siphon 18–20 also decreases and the siphon allows liquid to flow from the tank 1 into the removing pipe 13 via pipe 14, jet pump 17, siphon 18–20, tee 25 and pipe 26. This means that the electrodes 2, 3 generate signals for continuous admission of liquid via pipe 5*c*. Such continuous admission can be readily ascertained, either visually or by a suitable monitoring device which transmits signals to a digital or other suitable display device for ready recognition by the attendant or attendants.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a developing machine for radiation-sensitive material, the combination comprising a vessel having an upper portion and a lowermost portion and arranged to normally confine a body of liquid having an upper surface located at or close to a predetermined level; means for circulating the liquid along a first path extending from the lowermost portion, outside of and to the upper portion of said vessel, said circulating means including pipe means and a first pump installed in said pipe means; liquid removing means; and means for evacuating the contents of said vessel in response to stoppage of said first pump along a second path extending between an intermediate portion of said first path and said removing means, said evacuating means including a jet pump installed in said intermediate portion of said first path and having a suction side, and a siphon having an intake end connected with said suction side and a discharge end connected with said removing means, said siphon having an uppermost section disposed at a level above said jet pump and below said predetermined level.

2. The combination of claim 1, wherein said jet pump is disposed at a level below said lowermost portion of said vessel.

3. The combination of claim 2, wherein said siphon further comprises an upright section extending from the suction side of said jet pump to said uppermost section.

4. The combination of claim 3, wherein said jet pump is dimensioned to maintain the upper surface of liquid in said upright section at a level below said uppermost section as long as said first pump causes the liquid to flow along said first path.

5. The combination of claim 1, wherein said uppermost section is located at such a distance from and below said predetermined level that the liquid which rises in said siphon on stoppage of said first pump and attendant deactivation of said jet pump can rise into said uppermost portion and thereupon flows from the lowermost portion of said vessel, toward and through said siphon, and into said liquid removing means.

6. The combination of claim 1, further comprising means for admitting air into the uppermost section of said siphon at the will of an operator.

7. The combination of claim 6, wherein said admitting means comprises an upwardly extending tubular connector having an end portion communicatively connected with said uppermost section and a normally closed aerating valve in said connector.

8. The combination of claim 1, wherein said first pump is disposed at a level between said lowermost portion of said vessel and said predetermined level.

9. The combination of claim 1, wherein said siphon further comprises two upright sections flanking said uppermost section.

10. The combination of claim 1, wherein said pipe means includes a first pipe communicating with the lowermost portion of said vessel and disposed at a level below said vessel and a second pipe extending upwardly from said first pipe and discharging into the upper portion of said vessel.

11. The combination of claim 10, wherein said jet pump is installed in said first pipe.

12. The combination of claim 10, wherein said first pump is installed in said second pipe.

13. The combination of claim 10, further comprising a third pipe connecting said first pipe with said removing means downstream of said jet pump and a shutoff valve in said third pipe.

14. The combination of claim 1, wherein said removing means is located at a level below said first pipe.

15. The combination of claim 1, further comprising means for admitting into said vessel fresh liquid when the upper surface of liquid in said vessel drops below said predetermined level and means for removing liquid from said vessel when the upper surface of the body of liquid in said vessel rises above said predetermined level.

* * * * *